US005577551A

United States Patent [19]

Kritzler et al.

[11] Patent Number: 5,577,551

[45] Date of Patent: Nov. 26, 1996

[54] REGENERATIVE HEAT EXCHANGER AND METHOD OF OPERATING THE SAME

[75] Inventors: Gerhard Kritzler, Freudenberg; Siegfried Schlüter, Wenden-Rothemühle, both of Germany

[73] Assignee: Apparatebau Rothemuhle Brandt & Kritzler GmbH, Wenden-Rothemuhle, Germany

[21] Appl. No.: 298,443

[22] Filed: Aug. 29, 1994

Related U.S. Application Data

[63] Continuation-in-part of Ser. No. 118,838, Sep. 8, 1993, abandoned.

[30] Foreign Application Priority Data

Sep. 9, 1992 [DE] Germany ..... 42 30 133.5

[51] Int. Cl.[6] ..... F28D 19/00

[52] U.S. Cl. ..... 165/9; 165/8

[58] Field of Search ..... 165/5, 7, 9, 1, 165/8

[56] References Cited

U.S. PATENT DOCUMENTS

| | | | |
|---|---|---|---|
| 3,157,226 | 11/1964 | Atwood | 165/9 |
| 3,194,302 | 7/1965 | Sven-Olof Kronogard | 165/9 |
| 3,977,464 | 8/1976 | Mai | 165/9 |
| 4,098,323 | 7/1978 | Wiegard et al. | 165/9 |

*Primary Examiner*—A. Michael Chambers
*Attorney, Agent, or Firm*—Anderson, Kill & Olick P.C.

[57] ABSTRACT

A regenerative heat-exchanger is disclosed which has a rotor mounted in an enclosing housing, with separation zones radially disposed between the heat exchange media and configured as peripheral and radial barrier chambers, and stationary peripheral and radial seals which are arranged on hot and cold sides of the rotor.

9 Claims, 3 Drawing Sheets

200
9
13
27
24
27
25
9
5
16
2
14
15
28
25
27
14
15
16
6
12

REGENERATIVE HEAT EXCHANGER AND METHOD OF OPERATING THE SAME

This application is a continuation-in-part of application Ser. No. 08/118,838, filed Sep. 8, 1993, for "Regenerative Heat Exchanger and Method of Operating the Same" now abandoned.

BACKGROUND OF THE INVENTION

The invention relates to a regenerative heat-exchanger having a rotor with peripheral, radially and axially sealed-off, heat storage banks, which can be utilized both in an air pre-heater and a gas pre-heater.

In the case of power plants and industrial furnaces, the flue gases are used in a regenerative heat exchanger for pre-heating of the combustion air. In this process, it is possible, for example, to reduce the nitrogen oxides ($NO_x$) contained in the flue gas by a very considerable amount, by implementing, in this case, the heat storage banks in the regenerative heat exchanger as totally or partially effective catalytic elements and, above all, by introducing ammonia as the reducing agent. As a general rule, a flue gas containing nitrogen oxides is produced by a furnace and is used at the end of a steam generator for pre-heating of the combustion by flowing through the regenerative heat exchanger.

According to the present state of the art, as e.g., disclosed in the prospectus "Regenerative Heat Exchangers" of Lugat Aktiengesellschaft fur Luft and Gastechnik, Basel, in the case of regenerative heat exchangers with peripheral heat storage banks, the rotors and the rotor chambers or storage bank chambers are sealed off, both in the radial direction and in the axial direction, to prevent any possibility of mixing of one medium with the other, that is to prevent the possibility of mixing of the crude gas with the purified gas. Therefore, in the case of rotor seals with rotating heating surfaces, resilient metal sliding contact strips are provided. These strips are affixed to all of the radial walls and are adjusted in such a manner that they make sliding contact with radial spars of the heat exchanger housing. Additionally, there are metal sliding contact strips provided in the peripheral regions of both end surfaces of the rotor, which likewise make sliding contact with the rotor housing. The radial seals keep the media flowing through the heat exchanger separated from each other, and the peripheral seals allow to substantially avoid any bypass flow currents.

In the case of flue gas purification or reduction of noxious gases, large demands are made, at the present time to the individual components. Thus, for example, for a heat exchanger which, in a garbage incinerator plant, pre-heats the flue gas to the reaction temperature necessary for the catalytic purification, a leakage amount of significantly less than 0.3% is required in order to avoid emission of dioxin and furane. However, the known resilient sealing systems for a regenerative heat exchanger with peripheral heat storage banks cannot meet such requirements.

SUMMARY OF THE INVENTION

Accordingly, the object of the present invention is, therefore, to provide a regenerative heat exchanger of the above described type in which a high degree of leak proofing is achieved so that a leakage is avoided to the greatest possible extent.

This object is achieved in accordance with the present invention by having the rotor mounted in a housing, which peripherally encloses the rotor, and by forming the separation zones radially disposed between the heat exchange media as barrier chambers (peripheral and radial chambers), With the barrier chamber system achieved in this manner, it is possible to avoid any direct contact or heat transfer from one of the heat exchange medium to another, because the two flowthrough regions, at their inlet and outlet, that is on both sides of the rotor, are sealed circumferentially and are separated from one another by a barrier chamber. With the use of this type of rotor sealing, it is possible to prevent the heat exchange medium at a higher pressure from flowing directly into the medium at a lower pressure. Any leakage through gaps will rather accumulate first of all inside the housing of the heat exchanger and only then will flow out over the next seals into the region with the lower pressure. The flowing media are completely sealed at each of the end faces of the rotor, and double seals are provided in the radial direction at all locations in the heat exchanger.

Stationary peripheral seals, preferably designed as sealing strips having a length equal to the arc dimension of at least two heat storage bank chambers and arranged in the heat exchanger housing, are provided on the cold and hot end surfaces around the perimeter of the rotor, to delimit the peripheral chambers.

Stationary radial seals provided in the housing and located in the separation zones, on both sides of the rotor, should each completely cover at least one heat storage bank chamber. The radial seals are adapted to the dimensions and the contour of a rotor chamber, whereas for the end face peripheral seals, it is possible to use segmented, but essentially axially disposed ring segments. The radial seals are substantially strip shaped and designed with a widening portion on their outer lying ends. After the placing in position of the peripheral seals, the radial seals may be inserted flush between them. Thus, it is possible, in an advantageous manner, to arrive at the situation where the peripheral seals and the radial seals form continuous sealing surfaces, lying in a common plane, with a gapless transition between them where they abut each other.

According to another embodiment of the present invention, the peripheral seals and the radial seals are made elastic. In this case, in contrast to the known resilient lamellar sheet seals, the seals are configured as axially disposed wide sealing strips which adapt themselves, without problems, to the thermal expansion of the rotor caused by the operating conditions. They are, in accordance with the currently existing operational conditions, fully automatically adjusted, in the known manner, by a control sensor.

Because of the resilient flexible arrangement of the seals, it is not possible for the rotor, at greater temperature differences, to be locked in the housing, also accidental one-sided deformation of the seal, for example, due to the stoppage of the motor, would not result in locking of the rotor. This insures that the rotor can be started up again from any operating position at any time.

In accordance with yet another embodiment of the present invention, the peripheral chambers are subdivided, in the case of a regenerative heat exchanger with a vertical axis of rotation, into an upper chamber and a lower chamber, and in the case of a regenerative heat exchanger with a horizontal axis, into a rear chamber and a front chamber. In the region of the two chambers, cylindrical seals for their subdivision are placed around the rotor. The subdivided peripheral chambers, in an advantageous manner, allow for a modus operandi of the regenerative heat exchanger, in which, according to the given localized pressure relationships in the heat exchanger, at the sealing sites involved, a purposeful and appropriate exhaust, blockage, blowing-out or venting, can be effected. However, this type of modus operandi is also possible even with non-subdivided peripheral chambers.

The double seals extending in radial direction, in accordance with the present invention, make it possible, in an advantageous manner, to apply to the barrier chambers either suction, for example, with a fan, or to connect a gas blocking pipeline for applying a reduced pressure or an increased pressure, and also to connect a flushing-out gas pipeline to the radial chambers. This provides the possibility of purposefully avoiding, in a simple manner, either completely or partially, any leakage through gaps in the regenerative heat exchanger, for example, by suction or by introducing a barrier gas. Additionally, it is possible to minimize abrasive wear and tear in the relevant radial regions which could be caused by blow outs. Lastly, it is additionally achieved with every flushing-out operation, that every cell of the heat storage bank or chambers, which contain a crude gas charged with harmful substances, is flushed out with a clean gas before it gains access to the pure gas sector.

All of the rotor seals may be brought in a firm contact with the end surfaces of the rotor with mechanical devices depending on existing operational conditions. The adjustments may be effected manually or automatically, so that large areas of the peripheral seals, whose arc dimension should be equal to at least the arc length of two heat storage bank chambers, can be established from individual actuating points. For the actuation, levers may be employed which extend from the actuating points to the individual connecting sites on the seals. The number of actuating devices can be reduced because of this arrangement. To make actuating and applied pressure forces of the seals as small as possible, the weights of the sealing plates or rings are compensated for by counter weights on the lever arms. Compared with balancing springs, the counter weights have the advantage that the reaction forces remain constant even in different sealing positions.

Additional features and advantages of the present invention will become more apparent from the following detailed Description of the Preferred Embodiment when read with reference to the accompanying drawing.

DETAILED DESCRIPTION OF THE PREFERRED EMBODIMENTS

Figure 1:
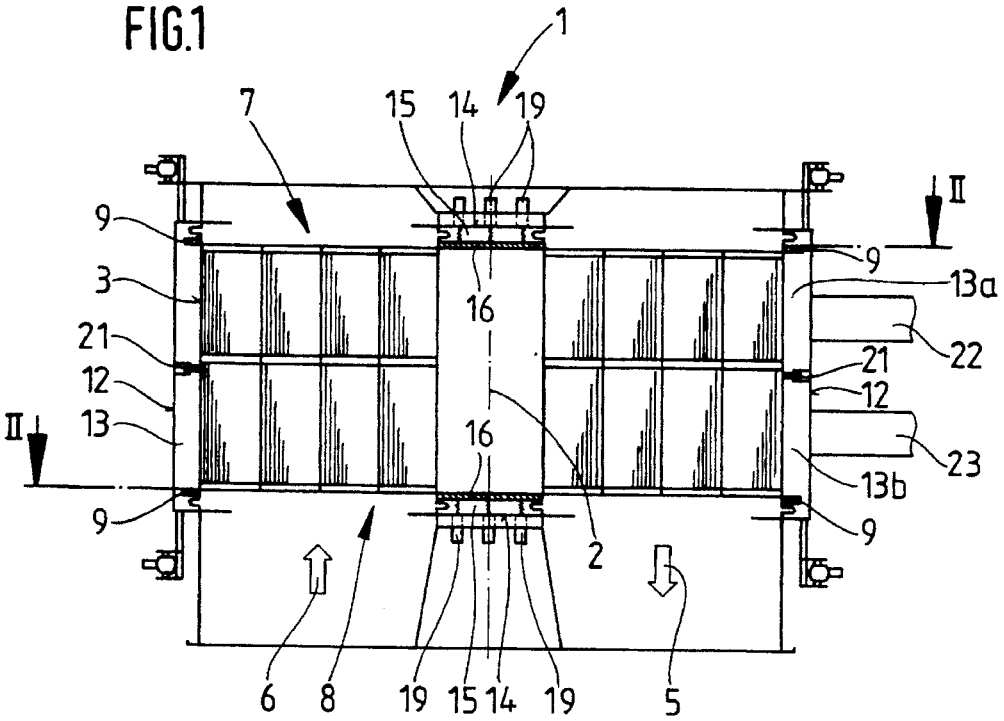
FIG. 1 is a diagrammatical cross-sectional view of an inventive regenerative heat exchanger having a peripheral heat storage bank.
Figure 2:
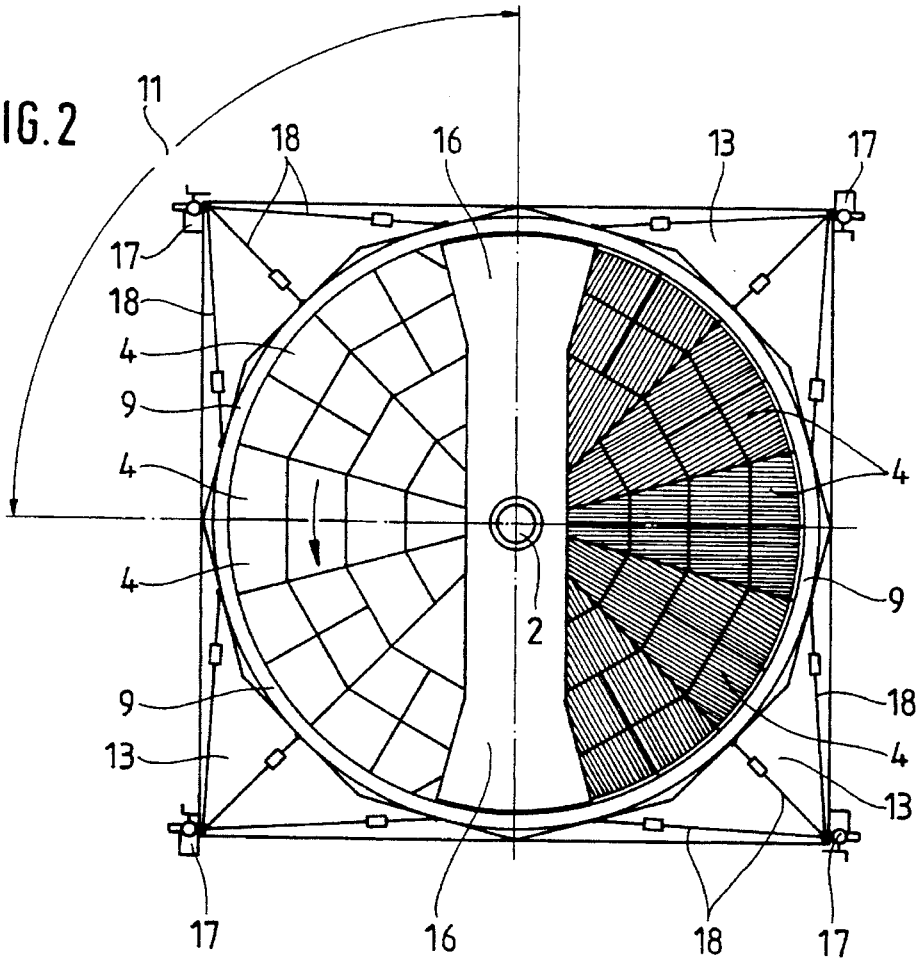
FIG. 2 is a sectional view through a regenerative heat exchanger shown in FIG. 1 along the lines II—II.

The regenerative heat exchanger 1, shown in FIG. 1, has a rotor 3, which rotates around a vertical axis of rotation. The rotor 3 includes a plurality of heat storage banks or chambers 4 (FIG. 2). The regenerative heat exchanger 1 has hot flue gas supplied through a duct extending from a steam generator (not shown) and flowing through it in the direction indicated by arrow 5, i.e. from top to bottom. A stream of pure gas or air flows through the rotor 3, as a counter current, in the direction indicated by arrow 6, to the heat storage bank chambers 4, which have been heated by the flue gas. The pure gas or the air cools the heat storage bank chambers 4 and flows upwards to exit through the hot side 7 from the heat exchanger.

Not only on the hot side 7, but also on the cold side 8, there are provided annular peripheral seals 9, which are stationary arranged in the housing and engage the rotor 3 on its outer perimeter. These seals are subdivided into segments and have an arc length 11, which is a multiple of the arc length of a heat storage bank chamber 4 (FIG. 2). In the example shown in FIG. 2, the peripheral seals 9 consist of four quarter circle rings which fit together snugly at their butt joints. In the region between the housing 12, which axially encloses the rotor 3, and the rotor 3, the peripheral seals 9 form barrier or peripheral chambers 13.

Furthermore, radial chambers 15 are located in the separation zones 14 which separate the two streams 5 and 6 of the media from each other (FIG. 1). Radial seals 16 are provided at the top and bottom of the rotor 3 in the separation zones 14.

The radial seals, which are also stationary arranged in the rotor housing, are substantially strip shaped, have widened ends, and are of such dimensions that they completely cover one heat storage bank chamber 4. In this manner, the media 5 and 6 flowing in a counter current fashion through the regenerative heat exchanger 1 over each of the end surfaces of the rotor, that is, not only on the cold side 8, but also on the hot side 7, are completely sealed off from each other. In this manner, double seals are provided in the heat exchanger, which extend in the radial direction of the rotor 3. The radial seals are of such dimensions that they are able, by bridging over the diameter of the peripheral seals 9, to fit into the peripheral seals 9. All the sealing surfaces, which are formed by the peripheral seals 9 and the radial seals 16, lie in one plane, that is, there is no offset between them. In addition, they are not perforated by drive or any other actuating elements.

The peripheral seals 9 and the radial seals 16 are elastic, that is, they are designed to be resilient and are pressed into contact with the rotor. For contact adjustment, there are several actuating points 17 for manual or fully automatic operation of the peripheral seals 9 not only on the hot side 7, but also on the cold side 8 of the rotor 3. In each case a large area of the peripheral seals 9 is allocated to one actuating point 17 from which a lever 18 extends to the seals. In this way, it is possible to influence the entire peripheral seals 9 from very few actuating points 17. For exerting pressure on the radial seals 16, positioning springs 19 (FIG. 1) are arranged on the closed radial chambers 15 located in the separation zones 14.

In the case of the regenerative heat exchanger 1, depicted in FIG. 1, the peripheral chambers 13 are subdivided into an upper chamber **13*a* and a lower chamber 13*b* by means of a ring seal 21 placed around the jacket of the rotor 3. Attached to the upper chamber 13*a* there is a pipeline 22 for an upper exhaust or pressure reduction and, the lower chamber 13*b* is connected with a pipeline 23 for a lower exhaust or pressure reduction. The pipelines serve the purpose of minimizing the leakage or its avoidance. The peripheral chambers 13, 13*a* and 13*b* and the radial chambers 15** are able to be evacuated in common or separately by a separate fan and are thereby kept at a reduced pressure or, in the reverse fashion, they can be subjected to the influence of a barrier gas or a flushing-out gas and brought to a state of increased pressure.

Figure 3:
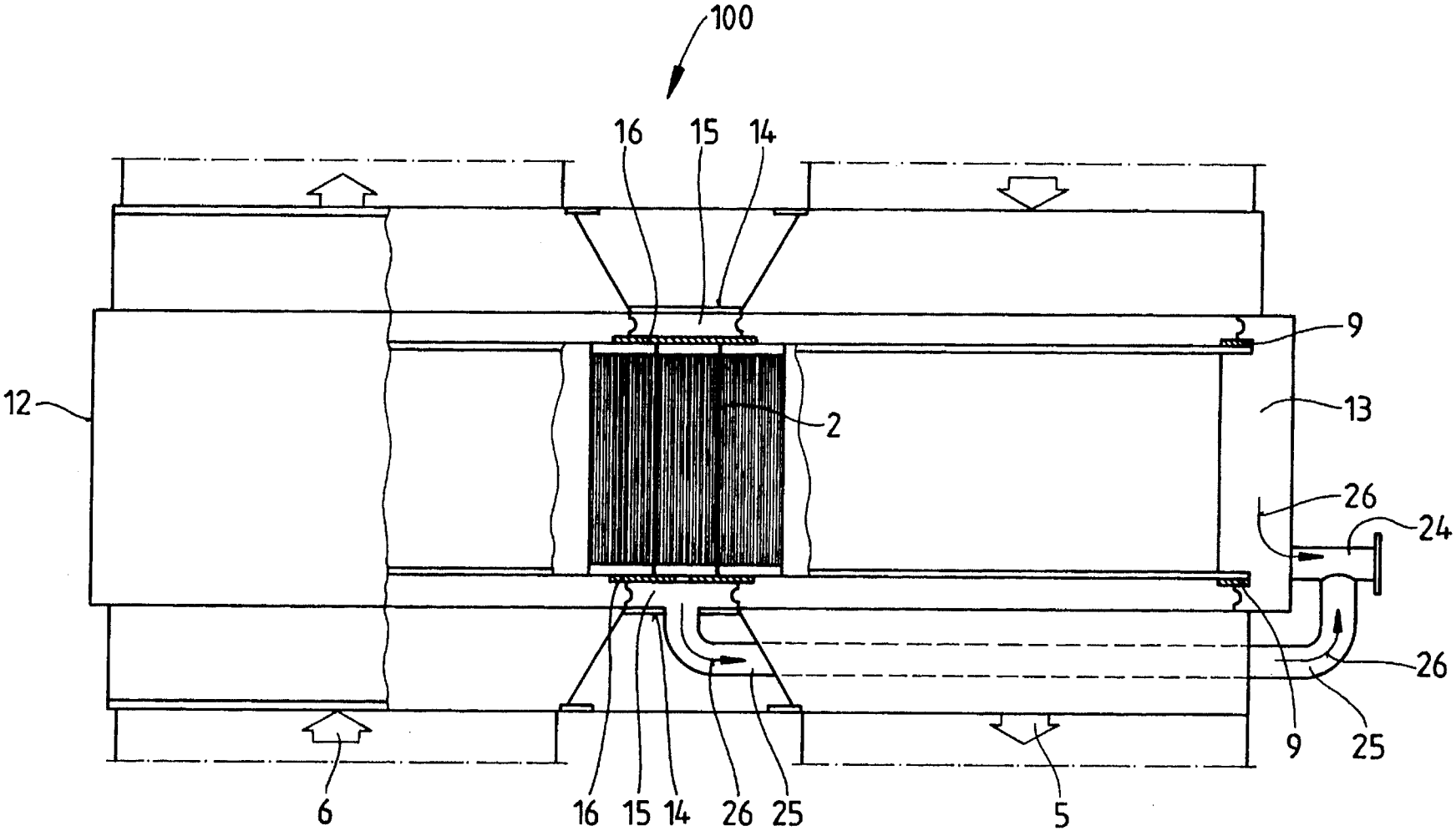
FIG. 3 is a partially broken front elevational view of a regenerative heat-exchanger with an attached leakage suction device.

In the embodiment of a regenerative heat exchanger 100 shown in FIG. 3, a more precise representation is given of a leakage suction device for the barrier chamber system and the sealing system. This device comprises pipe connections 24, 25 through which a fan (not shown) evacuates leakage in the direction indicated by the arrows 26 out of the peripheral chamber 13 and the bottom radial chamber 15 which, in this case, are not subdivided.

Figure 4:
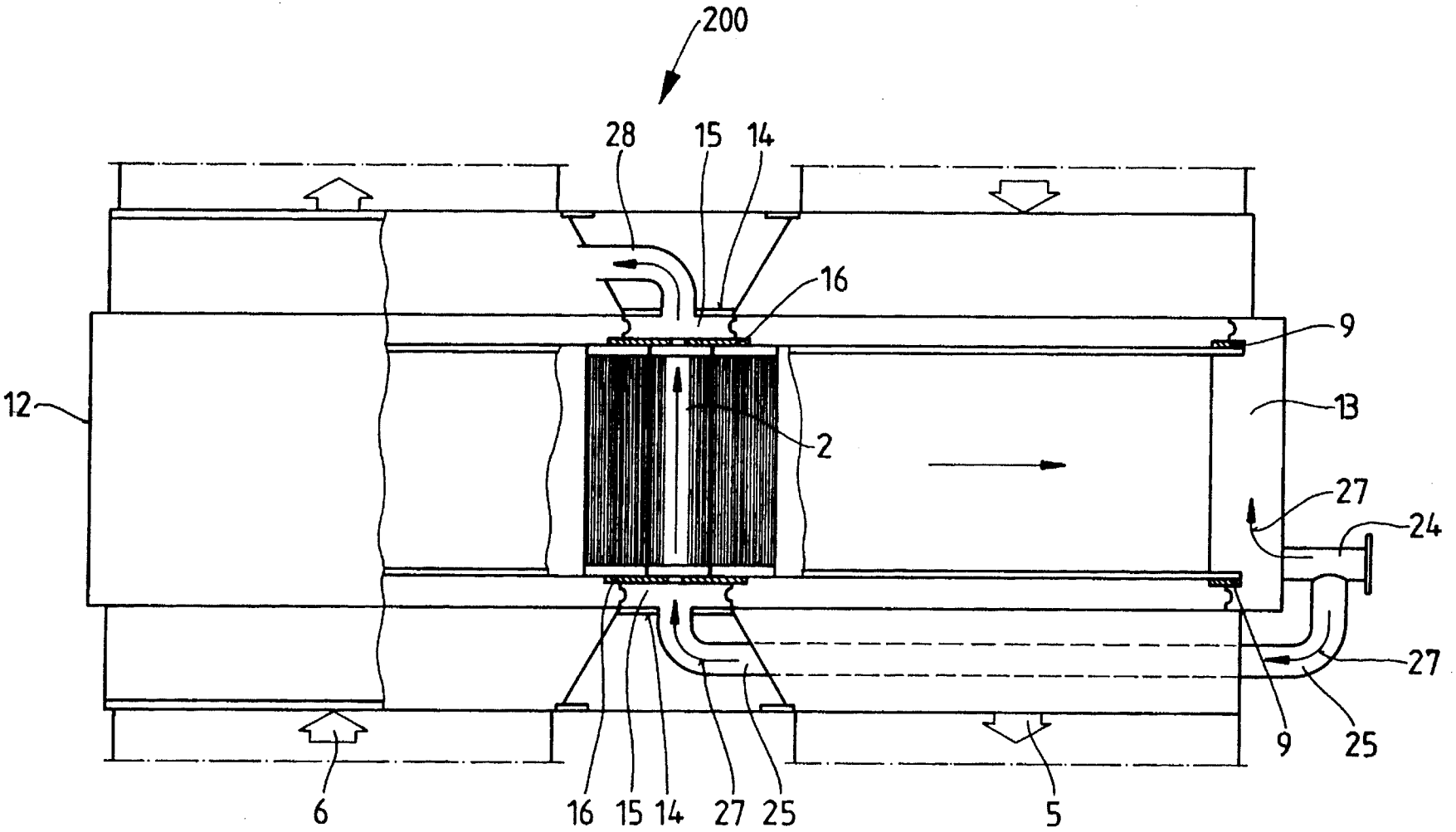
FIG. 4 is a partially broken front elevational view of a regenerative heat exchanger with an attached barrier gas device.

The regenerative heat exchanger 200 as shown in FIG. 4 differs from the embodiment shown in FIG. 3 in that the barrier gas and the flushing gas are introduced into the peripheral chamber 13 and the radial chamber 15 in the reverse direction through the pipes 24 and 25, as indicated by the arrows 27. In addition, there is another pipeline 28 attached to the upper radial chamber 15, by which, the introduced barrier gas and the flushing gas can be vented to the outside again after having flowed through the barrier chamber system and the sealing system.

While the present invention has been shown and described with reference to the preferred embodiments, various modifications thereof will be apparent to those skilled in the art and, therefore, it is not intended that the invention be limited to the disclosed embodiments or details thereof, and departures may be made therefrom within the spirit and scope of the appended claims.

What is claimed is:

1. A method of sealing a regenerative heat exchanger including a housing, a rotor located in the housing and having a plurality of heat storage bank chambers, and a means for separating heat exchange media and further including a plurality of peripheral and radial barrier chambers, said method comprising the steps of:

providing stationary flat arcuate peripheral seals resiliently engaging a perimeter of the rotor at hot and cold sides thereof for delimiting the circumferentially arranged barrier chambers;

providing stationary flat radial seals at the hot and cold sides of the rotor for covering at least one heat-storage bank chamber;

determining localized pressure relationships in the heat exchanger at respective sealing sites; and effecting appropriate exhaust, blocking, blow-out and venting operations in response to said localized pressure relationships.

2. A regenerative heat exchanger for use in power plants and industrial furnaces, the heat exchanger comprising:

a housing;

a rotor located in said housing and having a plurality of heat storage bank chambers; and means for separating heat exchange media, wherein said separating means comprises a plurality of peripheral and radial barrier chambers;

wherein said rotor has hot and cold sides, and wherein said heat exchanger further comprises stationary flat arcuate peripheral seals resiliently engaging a perimeter of said rotor at said hot and cold sides for delimiting the circumferentially arranged barrier chambers, and stationary flat radial seals arranged on said hot and cold sides and covering at least one heat storage bank chamber; and wherein said radial seals and said peripheral seals form a continuous sealing surface, which lies in a common plane and which has a continuous transitional area at locations where they join each other.

3. The regenerative heat exchanger of claim 2, wherein said peripheral seals comprise sealing strips which have an arcuate length equal to at least a double arcuate length of a heat storage bank chamber.

4. The regenerative heat exchanger of claim 2, wherein said radial seals are resilient.

5. The regenerative heat exchanger of claim 2, wherein said peripheral barrier chambers comprise an upper barrier chamber and a lower barrier chamber.

6. The regenerative heat exchanger of claim 5, further comprising a ring seal arranged between said upper and lower barrier chambers.

7. The regenerative heat exchanger of claim 2, further comprising suction means communicating with said peripheral and radial barrier chambers.

8. The regenerative heat exchanger of claim 2, further comprising a barrier gas conduit which is connected with said peripheral and radial barrier chambers.

9. The regenerative heat exchanger of claim 2, further comprising a flushing gas conduit which is connected with said radial barrier chambers.

* * * * *